US005678333A

United States Patent [19]

Aiken, Sr.

[11] Patent Number: 5,678,333

[45] Date of Patent: Oct. 21, 1997

[54] SCROLLING SIGN FOR MENU DISPLAY UNIT

[75] Inventor: Robert B. Aiken, Sr., Mequon, Wis.

[73] Assignee: Milwaukee Sign Co., Grafton, Wis.

[21] Appl. No.: 406,712

[22] Filed: Mar. 20, 1995

Related U.S. Application Data

[62] Division of Ser. No. 865,115, Apr. 8, 1992, Pat. No. 5,410,830.

[51] Int. Cl.[6] ..... G09F 11/18

[52] U.S. Cl. ..... 40/518; 40/471; 40/575

[58] Field of Search ..... 40/471, 518, 519, 40/520, 521, 522, 523, 574, 575, 576, 5, 618, 620

[56] References Cited

U.S. PATENT DOCUMENTS

| | | | |
|---|---|---|---|
| 3,426,461 | 2/1969 | Miller | 40/471 |
| 3,510,973 | 5/1970 | Mazzocco, Sr. | 40/471 |
| 5,174,055 | 12/1992 | Aiken | 40/471 X |

FOREIGN PATENT DOCUMENTS

| | | | |
|---|---|---|---|
| 1188884 | 12/1957 | France | 40/576 |

*Primary Examiner*—Brian K. Green

*Attorney, Agent, or Firm*—Andrus, Sceales, Starke & Sawall

[57] ABSTRACT

A changeable scrolling web sign for selectively displaying a variety of menu items and pricing information in a viewing window includes a scrolling web adapted to receive interchangeable information panels. The mounts for mounting the information panels on the web permits the information panels to move relative to the web in a direction substantially parallel to the scrolling direction of the web for permitting the web and panels to be wound on and paid out from cylindrical take-up rolls. A cover is placed over the information panel when positioned in the viewing window of the menu board for maintaining the information panel in a flat, planar viewing position. The sliding movement permitted between the information panel and the web accommodates the varying radii created as the web and information panel are wound on and unwound from the web take-up rolls. The scrolling web sign is adapted to be backlighted to enhance the aesthetics of the display. The scrolling web mechanism is adapted to be retrofitted in display units adapted for displaying single sheet panels.

9 Claims, 10 Drawing Sheets

FIG. 1
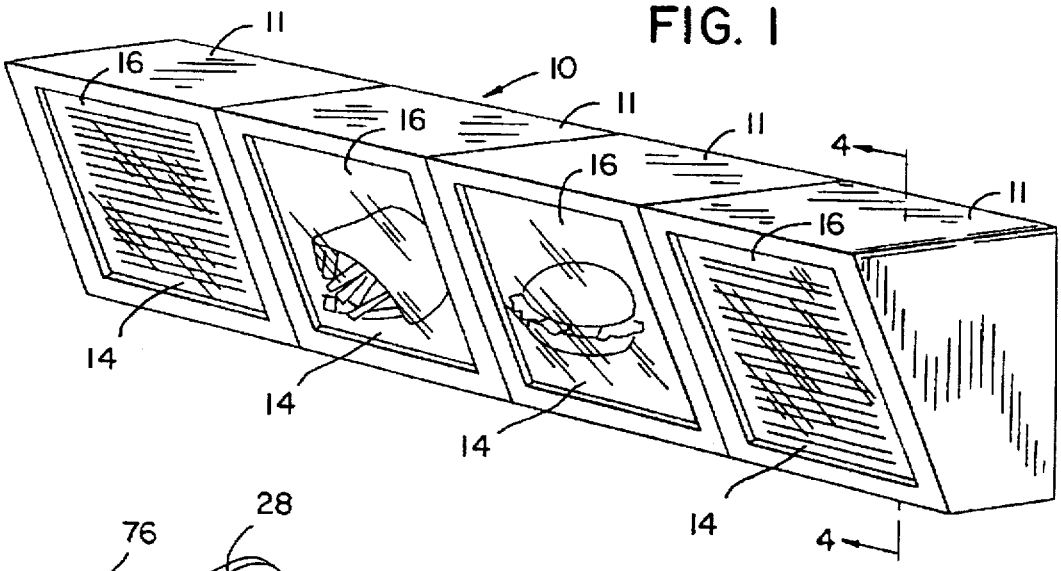
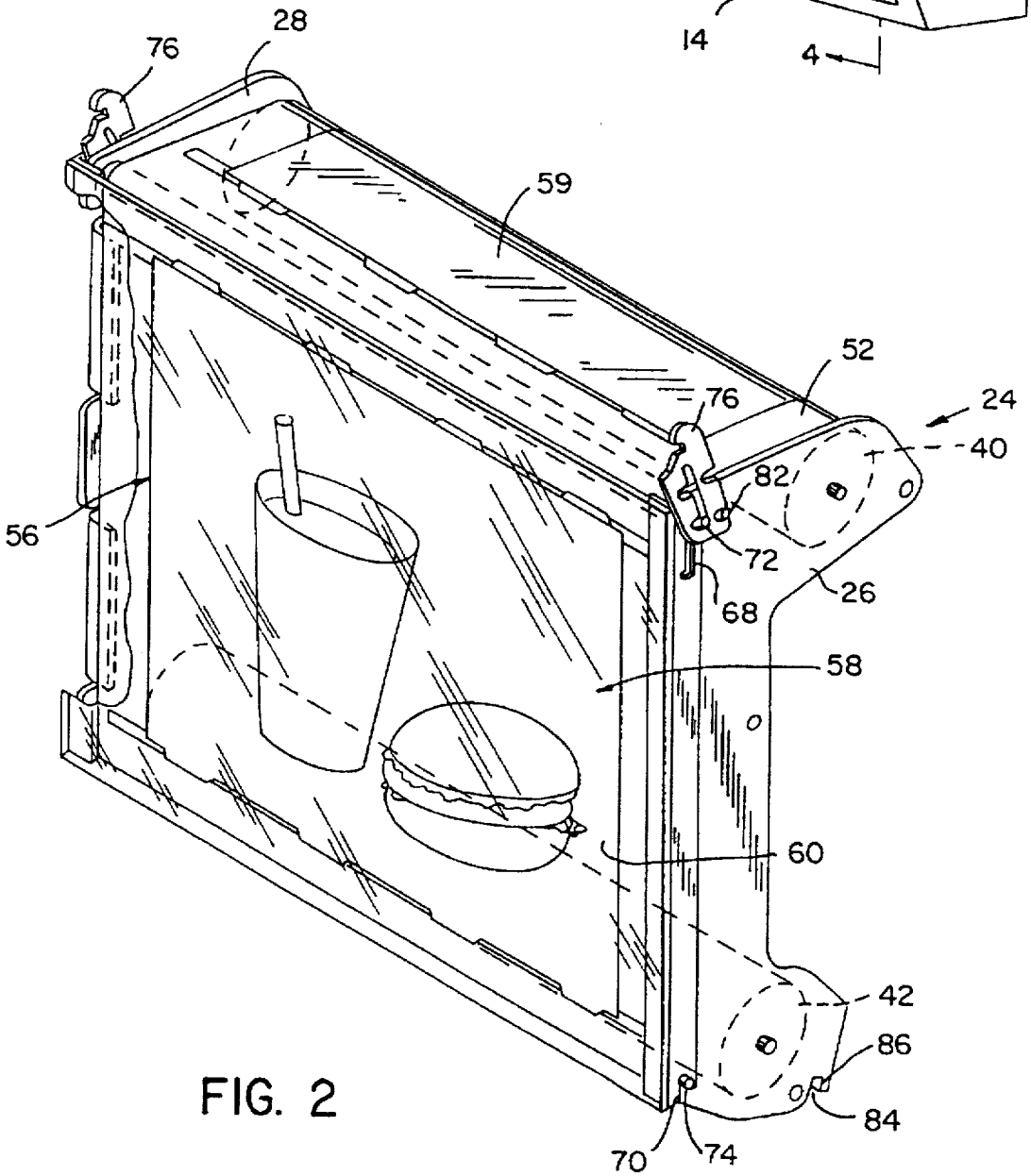
FIG. 2

FIG. 4
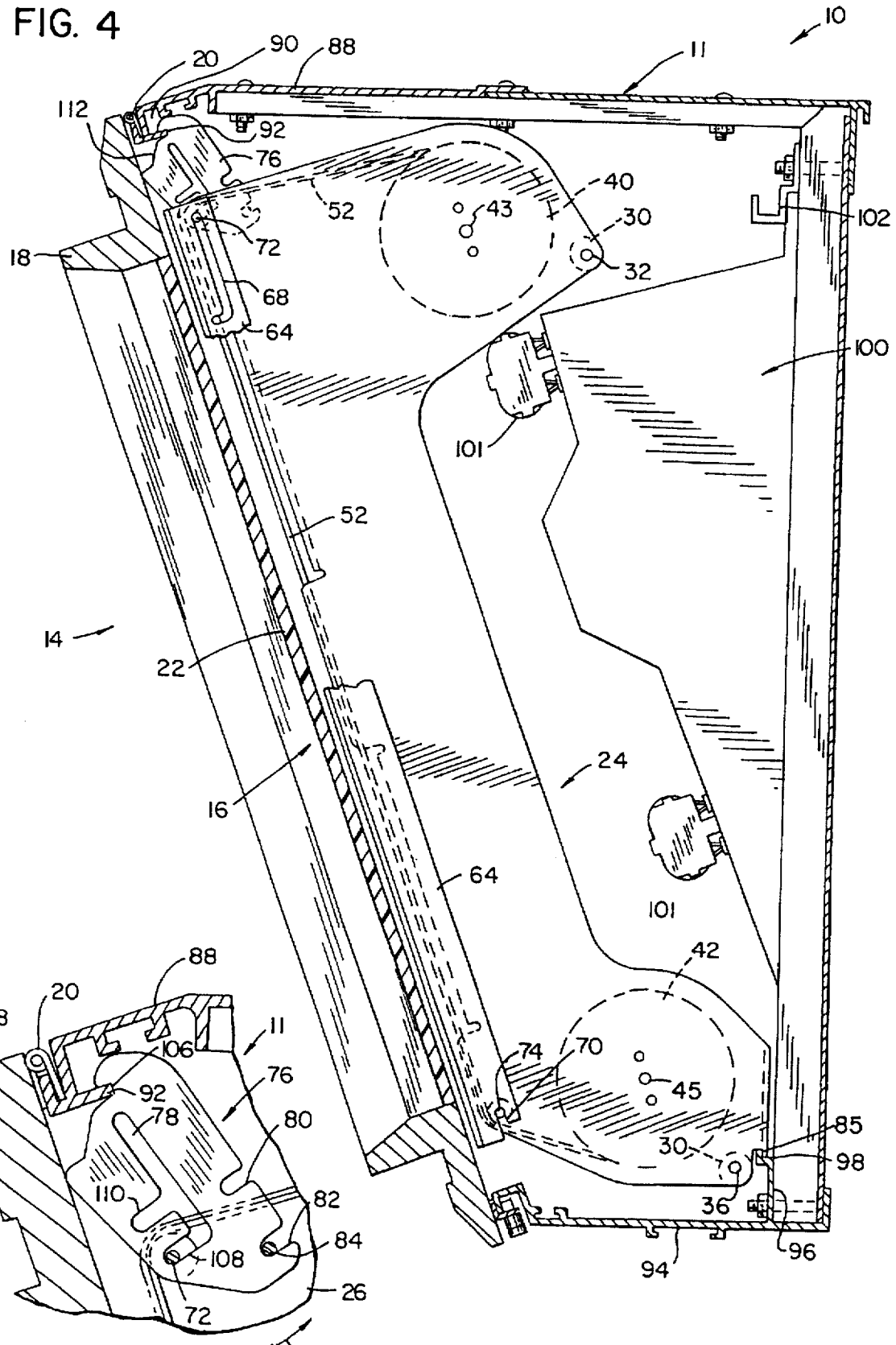
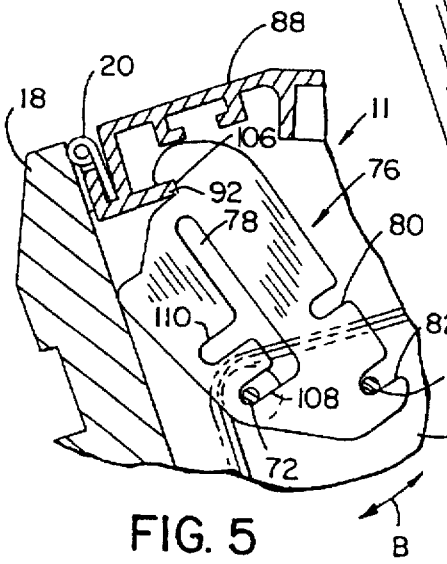
FIG. 5

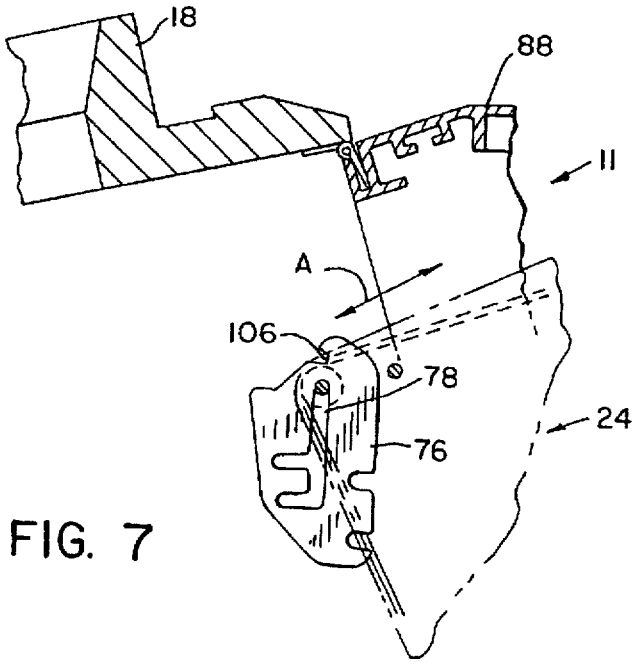
FIG. 7
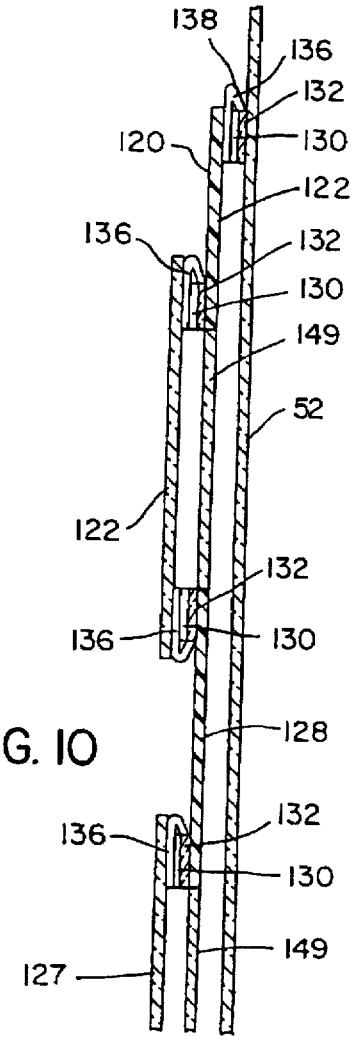
FIG. 10
FIG. 9
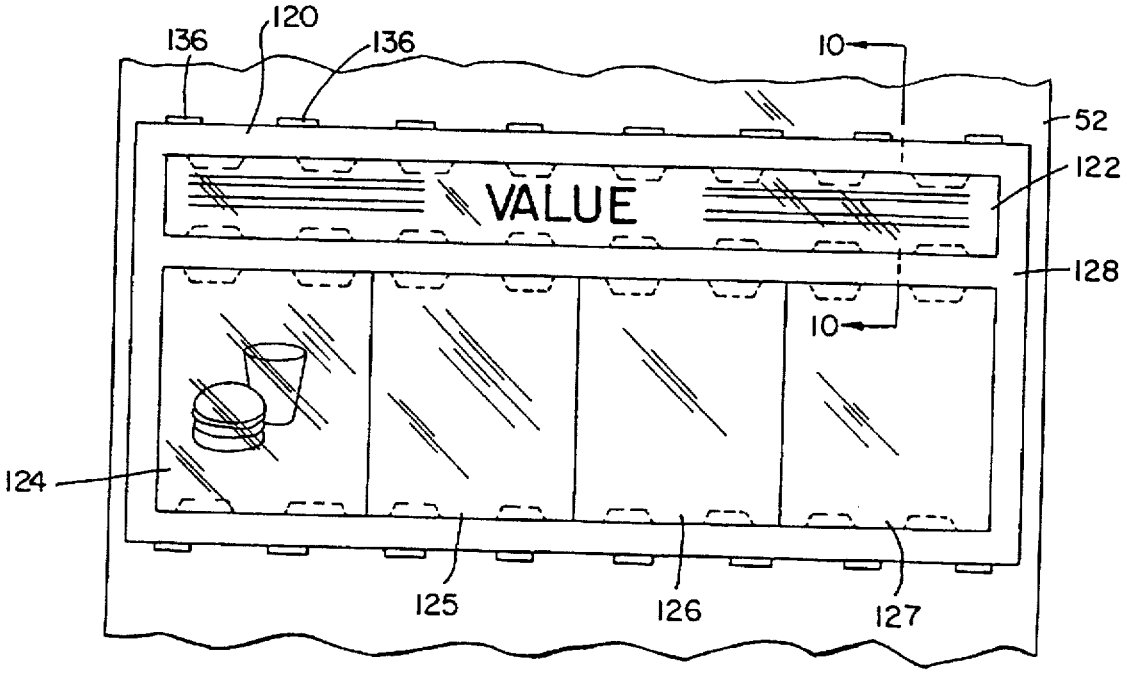

FIG. 8
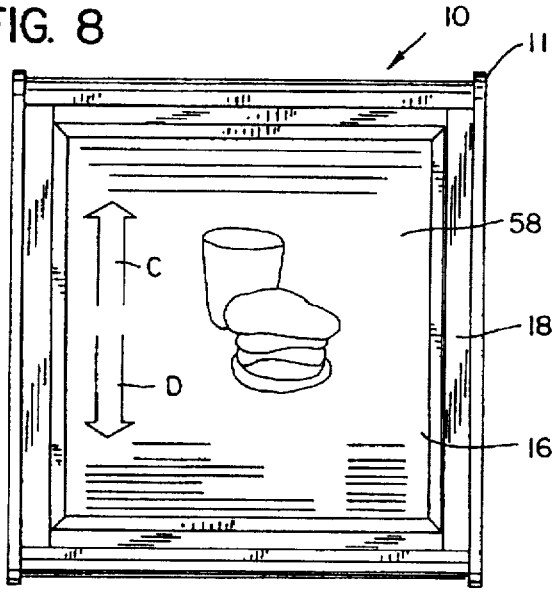
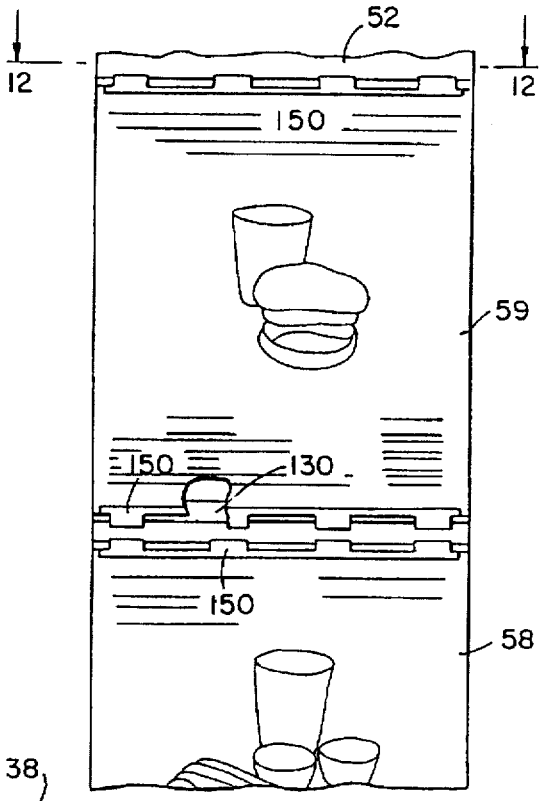
FIG. 11
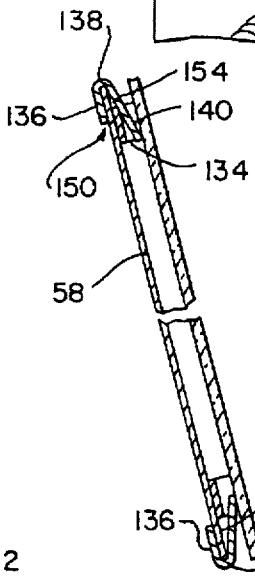
FIG. 13
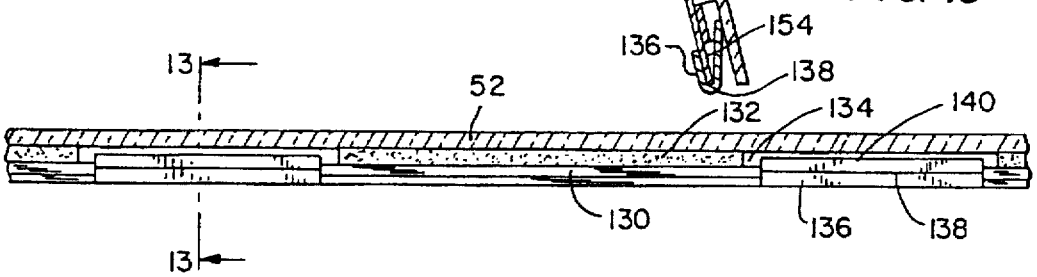
FIG. 12

FIG. 14
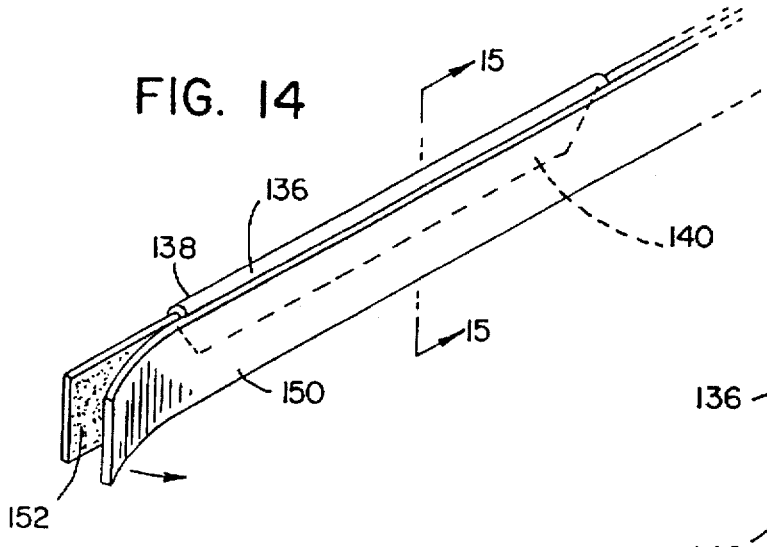
FIG. 15
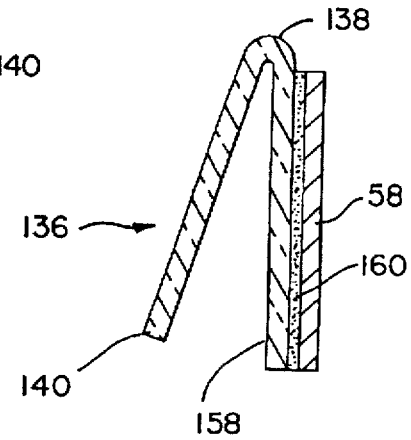
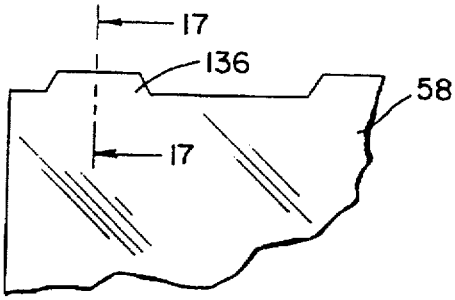
FIG. 16
FIG. 18
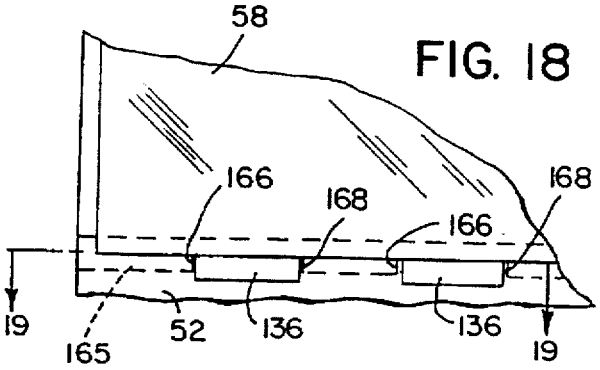
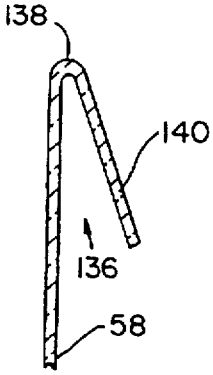
FIG. 17
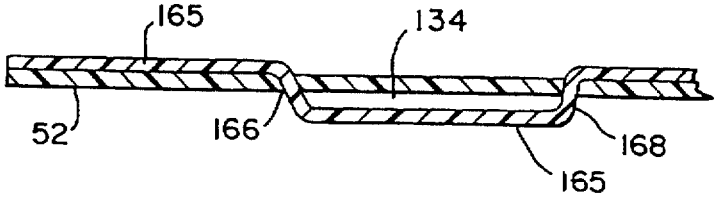
FIG. 19

FIG. 26
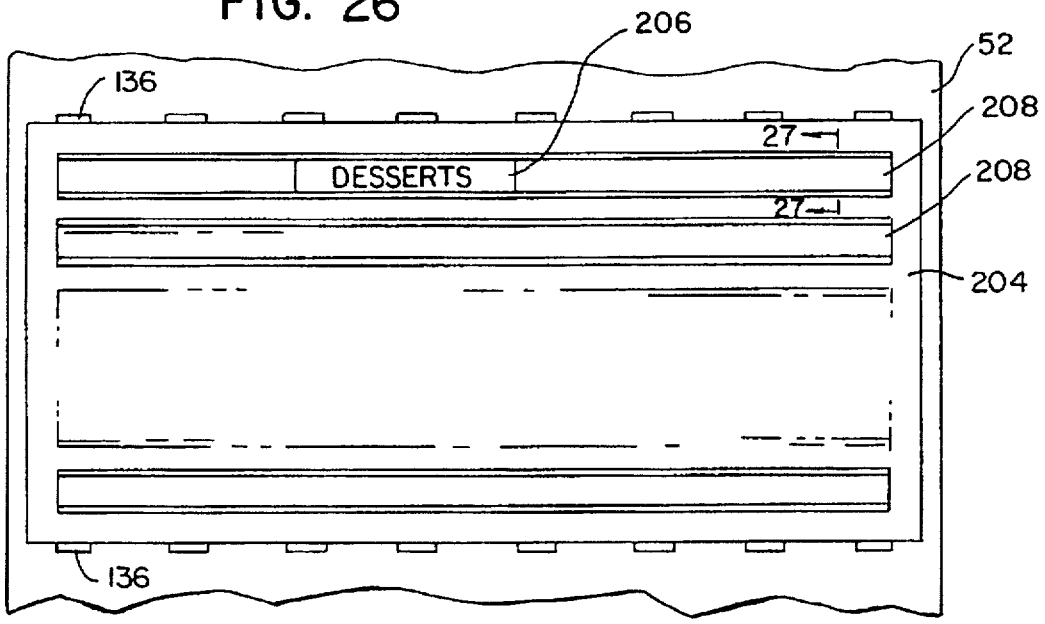
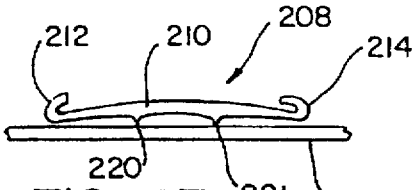
FIG. 27
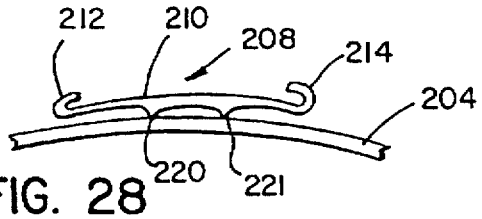
FIG. 28
FIG. 29
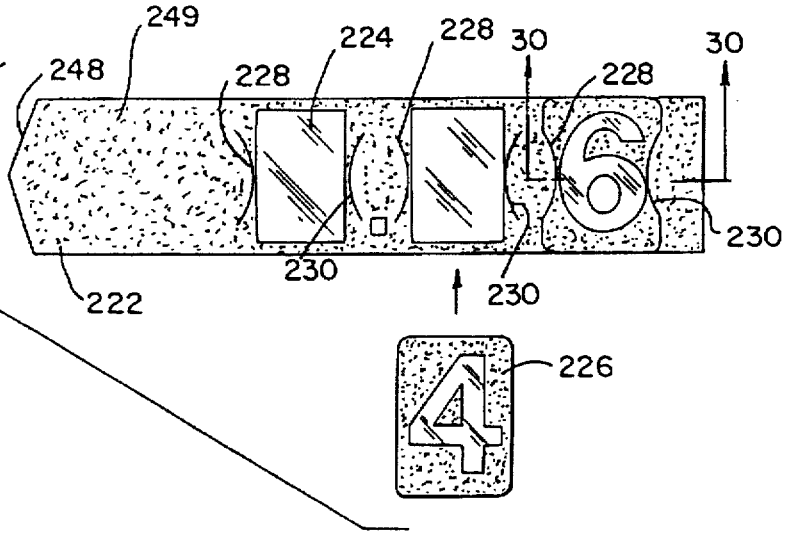
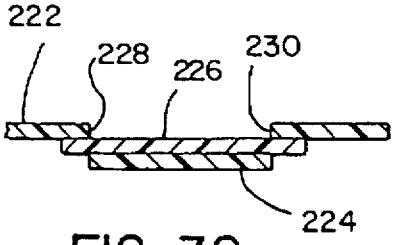
FIG. 30

FIG. 31
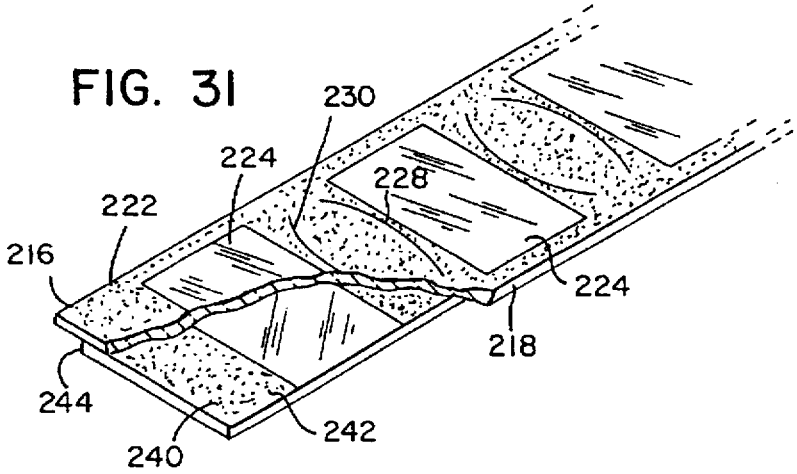
FIG. 32
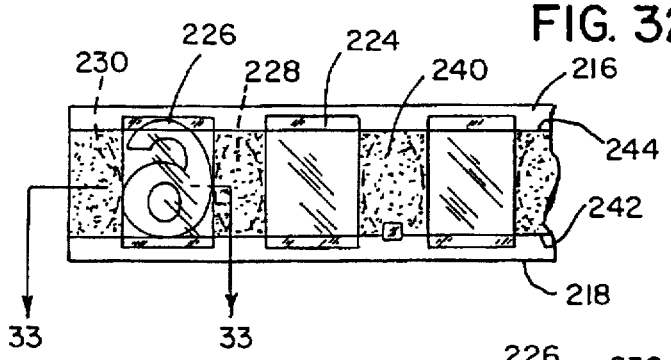
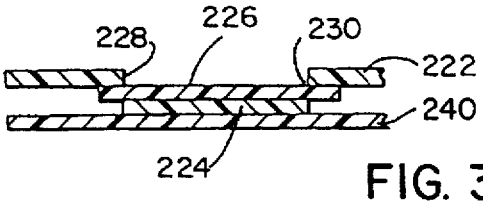
FIG. 33
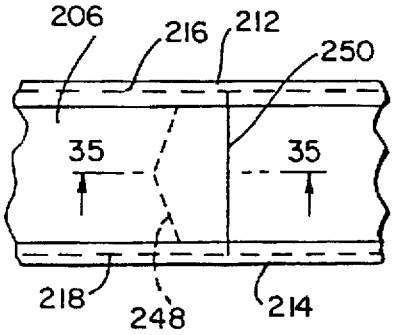
FIG. 34
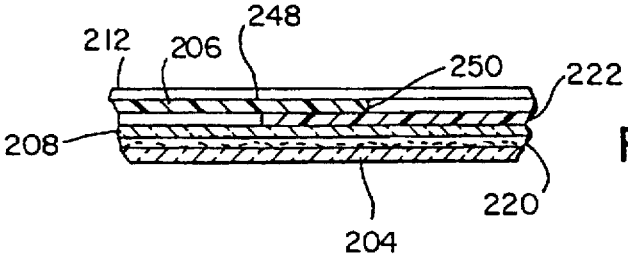
FIG. 35

SCROLLING SIGN FOR MENU DISPLAY UNIT

This is a divisional application of U.S. patent application Ser. No. 07/865,115 filed Apr. 8, 1992, now U.S. Pat. No. 5,410,830.

BACKGROUND OF THE INVENTION

1. Field Of The Invention

The subject invention relates to scrolling sign mechanisms in which the display of graphic or textual information may be changed by scrolling a web containing the information across a viewing window in the sign. The invention is specifically directed to a scrolling sign mechanism wherein the graphic or textual information is contained on removable panels.

2. Description Of The Prior Art

There are numerous applications in which it is desirable to change the information displayed by a sign. Typical of such applications are signs involved in the advertising and merchandising of products as in fast food restaurants where menu items and prices are often displayed in backlighted units located behind the counter. In such signs, it is often desired to change information regarding the availability of a product for sale, pricing and other data.

Using fast food restaurants as an example, pricing, pictures of food items and other information are displayed on the display unit. The unit may be above the service counter, exterior to the restaurant, or elsewhere. All or a portion of the menu board may be backlighted to draw attention to the sign and increase its legibility. It is desirable in such circumstances to change the graphics, such as pictures of menu suggestions, and/or associated alpha-numeric information such as, by way of example, descriptions, portion sizes, pricing and the like. These changes could occur in connection with menu suggestions for breakfast, lunch or dinner. This type of information would be changed regularly on a daily basis. In addition to these daily changes, it may also be desirable to have the capability of accommodating less frequent changes of information, for example, the display of information relating to merchandise suitable for a particular season, for a special event or promotion, or for a special target market of customers.

Prior art signs, such as menu boards and the like, typically use individual sheets for the graphics and individual characters or groups of characters for alpha-numeric information strips mounted on fixed panels. This makes changes difficult and time consuming, reducing the flexibility of the sign system.

More recently, scrolling sign mechanisms have been employed and overcome many of the disadvantages of the prior art signs. A typical scrolling sign is shown in U.S. Pat. No. 4,741,118 issued May 3, 1988 to the present inventor and others. In the sign there disclosed, the information is printed or coated on the web which is scrolled passed the window in the sign. While such a sign permits the alpha-numeric information to be changed, the changes are limited to those permanently printed on the web. If additional changes are desired, it is necessary to change the web. This sign is particularly useful for gas stations and the like but cannot be readily adapted to a restaurant menu sign where frequent graphic changes are desired. Other examples of signs of this type are disclosed in U.S. Pat. Nos. 3,426,461; 4,680,883 and 3,496,664.

It is also known to provide information panels or sheets that may be removably mounted on a supporting web or strip, see for example, U.S. Pat. No. 3,510,973 to Mazzocco, Sr. and U.S. Pat. No. 3,780,458 to Jacobi, et al. The sheets or panels containing the information may be removably affixed to the strips by clips, pins or tape.

However, the two-ply web and information panel combination has created problems as the web is unwound from a supply roll and wound up on a take up roll. Slack develops in either the web or the panels because the web and panel have different radii when wound on the rolls. The two-ply combination adds to the bulk of the web when wound on the rolls and can limit the number of panels that can be placed on the strip. If the strip and panels are tight on the rolls, the stack appears in the viewing window as buckling, detracting from the aesthetic features of the sign.

Various techniques have been devised to overcome this problem. For example, my earlier filed U.S. Pat. No. 5,174,055, filed Aug. 21, 1990 discloses a sign positionable within an enclosure having a viewing window, with a pair of spaced web rolls journaled for rotation with a web extending between the rolls for movement along a path for advancing the web past the viewing window. The web includes a strip having mounted thereon one or more informational panels arranged in series along the web. The panel is mounted on the strip such that the strip and sheet are rolled up smoothly with controlled tension on the rolls. The first guide means is mounted in the module and positioned behind the web. A second guide means is mounted in the module on the other side of the web to form a gap through which the web extends in its path between the rolls. The gap between the first and second guide means is narrowed along the path of the web, typically in a location which is centered with respect to the rolls. The slack occurring in the panel when the panel appears in the window of the enclosure is thus forced to the ends of the panel by the narrowing of the gap. This insures that the panel will appear in a flat, planar condition in the window of the sign to provide a highly effective and aesthetically pleasing display of the information on the panel.

More importantly, there are literally thousands of installations of sign and menu units in fast food restaurants and similar applications utilizing a single panel mounted in a frame on the front of a light box or the like. In order to incorporate any of the changeable sign mechanisms of the prior art, it is required that these installations be dismantled and discarded, or in the least, substantially overhauled. This can require shut down of the operation during changeover, causing a loss of revenue in addition to the expense involved in removing the old sign system and replacing it with a new, changeable sign system. While the changeable sign systems permitting frequent changes of both the graphics and the pricing information provided on the sign are highly desirable in fast food restaurants and similar installations, the advantageous features of such systems have to be balanced against the cost of changeover both in lost time and in equipment expense.

SUMMARY OF THE INVENTION

The present invention is directed to a changeable sign system utilizing a scrolling sign mechanism wherein the information panels are mounted on the web in such a manner to permit the panels to move relative to the web as the web is wound on and unwound from the web rollers, maintaining the information panel in a flat, planar condition when in the viewing window while permitting the panel to move relative to the web to accommodate the differing radii of the web in the panel as it is rolled about the rollers. In the preferred embodiment of the invention, the web is defined by a continuous base sheet having means mounted on the front surface thereof for defining a channel which is parallel to the axes of the rollers, wherein the information panel is placed in and secured loosely in the channel, permitting the panel to move relative to the web in a direction substantially parallel to the scrolling direction of the web. The panels may be readily mounted on and removed from the web, permitting a quick changeover of information displayed on the panels. The panels may either contain graphic information or alpha-numeric information such as product descriptions, pricing, and the like. The alpha-numeric panels may include readily interchangeable alpha-numeric information strips or cards, permitting the alpha-numeric information to be altered within the panel.

It is a particularly important feature of the invention that the sign system of the preferred embodiment may be quickly inserted in most standard display units currently installed in fast food restaurants and the like without the use of special tools and with minimum modification of the basic unit. Specifically, the entire scrolling web mechanism and frame is adapted to be placed inside currently existing units between the illumination source and the display frame. The web and panels of the subject invention are adapted to be back-lighted to provide for illuminated translite panels identical in appearance to the current translite panels displayed in the frame of existing display units. The specific translite panel on display in the frame may be mounted directly on the continuous web. In the preferred embodiment, the web will contain a plurality of such panels, wherein the specific panel on display may be scrolled into position by scrolling the web on the rollers.

The scrolling web sign system of the subject invention provides a changeable sign system readily adapted for retrofit application in currently existing sign systems in fast food restaurants and the like. This permits quick changeover of the single panel display units of the prior art to a flexible scrolling sign system at a minimum of expense and with minimum down time.

In the preferred embodiment of the invention, the frame for supporting the scrolling sign mechanism is adapted to be inserted in the existing light box currently installed as standard equipment in many fast food restaurants and similar establishments. The outer side walls of the frame are configured such that the lower end of the framework may be inserted in the channel typically supporting the illumination equipment. The upper end of the side frame member includes a mounting system which is adapted to be retracted into a clearance position, permitting the lower end to be placed in the channel and the mechanism to be pivoted into the box. After the mechanism is properly pivoted into the box, a mounting system is extended outwardly from the top of the frame to engage a top structural member of the box, maintaining the framework and the scrolling sign mechanism in position in the box and in alignment with the display window of the box. The translite panels which are typically installed in the display frame are then adapted to be installed on the web, where they can be selectively displayed in the window by scrolling the web into position. The translite panels are then in the window in the same manner as the stationary panels of the prior art.

The mounting means for attaching the removable panels to the scrolling webs comprise a strip mounted on the web for defining an elongated channel disposed parallel to the axis of the web rollers and a plurality of fasteners on the information panel adapted to be loosely received in the channels. Typically, the panel includes fasteners at both of its outer ends, each set of fasteners adapted to be received in parallel channels on the web. This permits the channel to be held at its opposite outer ends, maintaining a relatively flat position of the panel against the web. When the web is scrolled in position where the panel is displayed in the display window, and is in a substantially flat, planar condition, the fasteners are loosely held in the channels.

In the preferred embodiment of the invention, the web mechanism may include a removable, flat, transparent cover disposed in the vicinity of the frame for sandwiching the panel between the web and the cover to maintain it in a flat, aesthetically attractive condition. It has been found that by placing the transparent cover in contact with the panel, the appearance of the panel when displayed in the window is not discernably different from the prior single stationary panel system.

In one embodiment of the invention, the mounting system comprises an elongate strip mounted on the web parallel to the axis of the rollers with one edge of the strip being free to define a channel between the web and the strip, and the information panel includes a plurality of U-shaped fastener tabs which are adapted to be loosely received in the channel.

In another embodiment of the invention, a plurality of spacers may be mounted in a spaced apart relationship on the web on a line parallel to the axis of the rollers for defining a gap. An elongated strip is then mounted on the spacers to define a channel between the strip and the web in each gap. A plurality of U-shaped fasteners are mounted on the information panel and may be loosely received in the channel.

In an additional embodiment of the invention, the mounting means may be an elongated, U-shaped strip for defining the channel, wherein the information panel can be placed directly into the channel.

In yet another embodiment of the invention, the mounting means may include an elongated strip mounted directly on the web and having a plurality of elongated through slots therein parallel to the axis of the rollers for receiving the U-shaped fasteners mounted on the information panel.

It is an important feature of the subject invention that the scrolling sign mechanism may be backlighted to provide an effective and aesthetically pleasing visual display. In the preferred embodiment of the invention, the backlighting means may be provided by the prior art equipment already in place in the field. The scrolling sign mechanism is designed to function effectively with any source of uniform illumination of the web.

It is, therefore, an object and feature of the present invention to provide for a changeable sign system utilizing a scrolling web construction wherein the web mechanism may be installed in existing equipment.

It is another object and feature of the present invention to provide means for securing the information panels to the scrolling web wherein the information panels may be readily installed and removed from the web without removing the installed web from the rollers.

It is an additional object and feature of the present invention to provide for an improved changeable display unit utilizing a scrolling web configuration wherein information panels are mounted on the web in such a manner that they are free to move in a limited manner relative to the web to assure that the panels are in a flat, planar condition when in the viewing window, while permitting smooth winding and unwinding of the web from the web rollers by accommodating for the varying radii created by utilizing a multiple ply display.

It is yet another object and feature of the subject invention to provide for a changeable menu utilizing an information panel in a viewing window with backlighting, wherein the mechanism is constructed in such a manner as to eliminate shadows.

Other objects and features of the subject invention will be readily apparent from the accompanying drawings and detailed description of the preferred embodiments.

BRIEF DESCRIPTION OF THE DRAWINGS

FIG. 1 is a perspective view of a menu display unit including a scrolling sign system in accordance with the subject invention.

FIG. 2 is a perspective view of a scrolling sign mechanism for use with the display unit of FIG. 1.

FIG. 4 is a section view taken generally along the line 4—4 of FIG. 1.

FIG. 5 is an enlarged fragmentary section view looking in the direction of FIG. 4.

FIG. 7 is a view looking in the same direction as FIGS. 5 and 6, illustrating the installation of the mechanism into a display unit.

FIG. 8 is a view showing one front display frame of a display unit as shown in FIG. 1.

FIG. 9 is a fragmentary view of a web including a modular panel mounted thereon.

FIG. 10 is an enlarged section view taken along the line 10—10 of FIG. 9.

FIG. 11 is a view looking in the same direction as FIG. 9, showing an alternative mounting means for mounting an information panel on a web.

FIG. 12 is a section view taken generally along the line 12—12 of FIG. 11.

FIG. 13 is a section view taken generally along the line 13—13 of FIG. 12.

FIG. 14 is a perspective view of a mounting strip adapted for application to a standard information panel, whereby the panel may be mounted on the scrolling web of the subject invention.

FIG. 15 is a section view taken generally along the line 15—15 of FIG. 14.

FIG. 16 is a fragmentary view of an information panel with integral mounting tabs.

FIG. 17 is a fragmentary section view taken generally along the line 17—17 of FIG. 16.

FIG. 18 is a fragmentary view looking generally in the same direction as FIG. 16, showing an information panel with an alternative means of securing the panel to the web.

FIG. 19 is an enlarged fragmentary section view taken generally along the line 19—19 of FIG. 18.

FIG. 26 is a view looking generally in the same direction as FIG. 9, illustrating a menu panel adapted for containing alpha-numeric information mounted on the web of the subject invention.

FIG. 27 is an enlarged, fragmentary section view taken generally along the line 27—27 of FIG. 26.

FIG. 28 is a view looking generally in the same direction as FIG. 27, showing the configuration of the menu panel and alpha-numeric strip channel when the web is rolled around one of the web rollers.

FIG. 29 is an elevation view of a alpha-numeric information strip with interchangeable panels.

FIG. 30 is a fragmentary section view taken generally along the line 30—30 of FIG. 29.

FIG. 31 is a perspective view of an alternative embodiment of an alpha-numeric information strip.

FIG. 32 is a plan view illustrating the reverse side of the alphanumeric information strip of FIG. 31.

FIG. 33 is an enlarged fragmentary section view taken generally along the line 33—33 of FIG. 32.

FIG. 34 is an enlarged fragmentary view, looking generally in the same direction as FIG. 26, showing the arrangement of adjacent alpha-numeric information strips in a single carrier channel.

FIG. 35 is a fragmentary section view taken generally along the line 35—35 of FIG. 34.

DETAILED DESCRIPTION OF THE PREFERRED EMBODIMENTS

Figure 3:
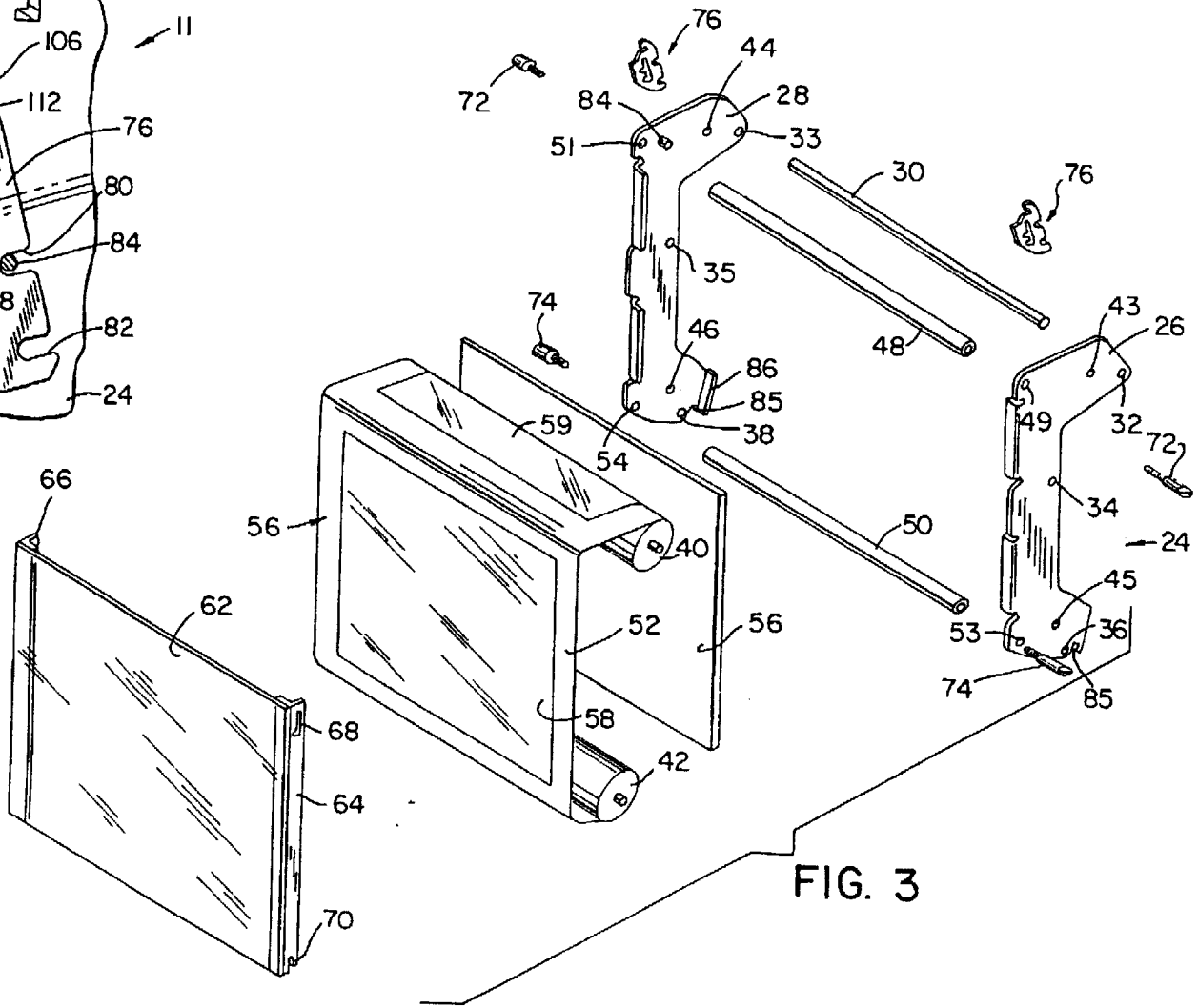
FIG. 3 is an exploded perspective view of the scrolling sign mechanism of FIG. 2.

A first embodiment of a display unit including a scrolling sign mechanism in accordance with the present invention is shown in FIGS. 1–5 and is designated, in general, by the reference numeral 10. Typically, the display unit 10 includes one or more independent light boxes 11, each having an enclosed frame having side walls for defining a box having an open front 14 defining a viewing area or window 16. As best shown in FIG. 4, the window typically includes a frame 18 hinged at 20 to the box 11 for defining the window 16. In most cases, each frame 18 includes a transparent panel 22 to protect the displayed material from the environment.

As is best shown in FIGS. 2 and 3, the scrolling sign mechanism 24 of the subject invention includes outer side frames 26 and 28 secured in spaced apart parallel relationship with one another by a plurality of cross members such as, by way of example, the cross member 30 which is adapted to be received in receptive holes 32, 33 on the respective side frames 26, 28. In the preferred embodiment, two cross members 30 and two radiused cross member 48, 50 are utilized and span the side frame members 26 and 28, with one cross member 30, mounted between holes 32, 33 and a second cross member 30 mounted between holes 36, 38, a radiused cross member 48, mounted between holes 49, 51 and a second radiused cross member 50 mounted between holes 53, 54. Radiused cross members 48 and 50 serving as guides for web 52 and mounting for display surface 56.

The assembled frame is adapted for receiving a pair of web rolls 40 and 42. The web roll 40 is mounted for rotation in through holes 43 and 44 on the respective side members 26, 28. The web roll 42 is mounted for rotation in the through holes 45, 46 in the respective side frame members.

An elongated web 52 has opposite ends secured to the rolls 40, 42 and is guided over radiused cross members 48, 50 and across the display surface 56 (FIG. 3) which is adapted to be placed in position behind the window 16 of the display unit, as shown in FIG. 1. The web 52 includes a plurality of removable display panels 58, 59 mounted thereon, such that a selected one of said display panels may be positioned in the window 16 by advancing the web 52 past the window by rotating the rollers 40 and 42 in the appropriate direction.

In the preferred embodiment, a transparent cover panel 62 is mounted in a pair of subframe sections 64 and 66 (FIG. 3) As shown in FIG. 2, the subframe members are adapted to be secured to side frames 26 and 28 with shoulder bolts 72. Specifically, an elongated L-shaped slot is provided at the upper end of each frame section 64, 66 and a U-shaped open ended slot 70 is provided at the lower end. With specific reference to FIGS. 2 and 3, the threaded portions of shoulder bolts 72 pass through holes 49 and 51 and engage the threaded holes in the end of radiused cross member 48. The shoulder portion of each bolt is adapted to pass through slot 68. The threaded portions of shoulder bolts 74 pass through holes 53 and 54 and engage the threaded holes in the end of radiused cross member 50. The shoulder portion is adapted to be engaged by open ended slot 70. When transparent cover 62 is in the position shown in FIG. 2, it sandwiches the information panel 58 on web 52 between the display surface 56 and cover 62, assuring that the panel stays in a relatively flat condition when it is positioned in front of display window 16. In the preferred embodiment, the web 52, panels 58, 59, the transparent display surface 56 and the transparent cover 62 are all made of a similar material such as, by way of example, Lexan.

Since all of the materials have a similar hardness, it has been found that it is beneficial to coat the web contacting surfaces of the transparent display surface 56 and transparent cover 62 in contact with the web 52 and panels 58, 59, with a transparent hardening compound to reduce scratching and marring of the surface of each of panels 56 and 62 as the web 52 and information panels 58, 59 scroll past. Tempered glass may also be used for display surface 56 and cover 62 where weight is not a consideration.

A pair of universal mounting brackets 76 are mounted on the shoulders of shoulder bolts 72 and positioned outside subframe sections 64 and 66 as shown in FIG. 2. As best shown in FIG. 5, each bracket 76 includes an F-shaped slot 78 and a pair of parallel, spaced apart open ended U-shaped slots 80 and 82. The shoulder bolt 72 is inserted through slot 78 for mounting the bracket on the assembly. A post 84 is provided on each frame member (see FIG. 3) and is adapted to be received in one of the slots 80, 82.

The lower end of each frame member includes an opened U-shaped slot 85 and an extended tab 86 projecting at right angles from the frame member (FIG. 3). The brackets 76 are used in combination with the slot 85 and tabs 86 to mount the assembled scrolling sign mechanism in the light box 11.

Most of the display units currently installed in fast food restaurants and similar installations are manufactured in one of two configurations. A first configuration is shown in FIGS. 4 and 5, wherein the top panel 88 of the box 11 is extruded to include the open channel 90 at the front top edge of the window 16. The extrusion for the top edge includes a substantially horizontally extending track 92 which runs the length of the window opening. The bottom panel 94 of the box includes an upstanding inner rail 96 having a track 98 projecting upwardly therefrom and running the full length of the rear of the box. In typical installations, the illumination system 100 is mounted between the track 58 and an upper track 102, also provided on the box 11, as shown in FIG. 4.

Figure 6:
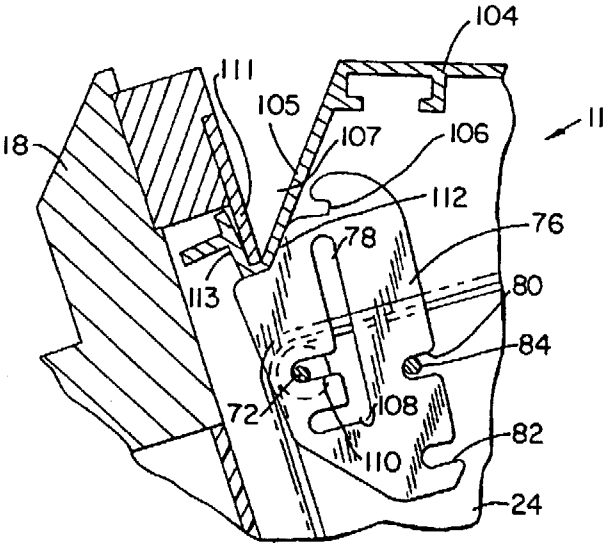
FIG. 6 is a view similar to FIG. 5, showing an alternative embodiment of the mechanism.

A second configuration of the box 11 is shown in FIG. 6, wherein the top panel 104 of the box is extruded in a shape including the front wall 105 and the upstanding rail 113 to define a V-shaped channel 107 for holding the mounting tab or tabs 111 on a frame 18 to provide a hinge for the frame. This permits the frame 18 to be vertically lifted out of the V-shaped channel 107 without the use of tools. The remainder of the box of the configuration shown in FIG. 6 is substantially identical to the box configuration of FIGS. 4 and 5.

The scrolling mechanism 24 of the subject invention is adapted to be installed in either of the box configurations without the use of any special tools or without any modification to the box or the assembly by utilizing the universal mounting brackets 76. In order to mount the assembly in the box having the configuration of FIGS. 4, 5 and 7, the frame 18 is first swung outwardly, as shown in FIG. 7 to provide a clearance opening for receiving the mechanism 24. Then, as shown in FIG. 4, the mounting tab 85 is inserted in the lower channel 98 for supporting the bottom of the unit. The top portion of the unit 24 is then pivoted into place, as indicated by arrow A of FIG. 7 with the brackets 76 in the position shown, at the base of the F-shaped channel 78. Once the unit is in the position shown in FIG. 4, the brackets 76 are moved upwardly (as drawn) along the F-shaped channels 78 until the notch 106 can be placed in engagement with the rail 92. The brackets 76 are then pivoted about notch 106, as shown in FIG. 5, to place the shoulder of shoulder bolt 72 in the lower, outer run 108 of the F-shaped slot and to place the notch 82 in positive engagement with the post 84 provided on the side 26 of the mechanism framework. This locks the bracket 76 in position and secures the upper end of the scrolling sign mechanism 24 in the box 11. The frame 18 may then be returned to its closed position, as shown in FIGS. 4 and 5.

The universal bracket 76 is also adapted for inserting the scrolling sign mechanism 24 in a box having the configuration of FIG. 6. As there shown, the frame 18 is suspended in the channel 111 and may be swung outwardly or completely removed by lifting the frame out of the V-shaped channel to provide a clearance opening in the front of the box 11. The scrolling sign mechanism 24 is then inserted in the box in the same manner as shown in FIGS. 4–7, with the mounting tab 85 being positioned in the lower channel 98 for securing the bottom of the mechanism in position. The mechanism is then pivoted into the box in the direction of arrow A, as shown in FIG. 7.

Once the mechanism is in position, as shown in FIG. 6, the brackets 76 are moved to the position with the shoulder of shoulder bolt 72 positioned in the middle run 110 of the F-shaped slot 78 and with the post 84 in engagement with the notch 80 for locking the bracket in position with the inclined wall 112 of the bracket and in positive engagement with the front inclined surface 105 of the box upper panel 104.

The universal brackets 76 provide a versatile mounting mechanism for mounting the scrolling sign mechanism 24 in a variety of configurations of light boxes without dismantling any portion of the light box.

Once the scrolling mechanism has been installed in the sign, the information panels positioned thereon may be scrolled into position in the window 16 of the display unit by scrolling the web in either direction, as indicated by arrows C and D of FIG. 8. While the changeable menu board with scrolling sign mechanism as shown in FIGS. 1–8 is adapted to be scrolled vertically past the viewing window 16, the subject invention may also be utilized to provide a scrolling sign wherein the web is adapted to be scrolled horizontally past the window. In the embodiment of FIGS. 1–8, the web 52 and viewing window 16 are inclined relative to a vertical plane to enhance the display of the information panels in a typical installation. It will be noted that illuminating means 100 is mounted with the light tubes 101 in parallel relationship with the plane of the viewing window 16 and the position of the web 52 in the window to assure uniform backlighting of the display.

FIGS. 9–13 show a first embodiment for mounting the information panels on the scrolling web 52. With specific reference to FIG. 9, a layered display may be utilized incorporating a base, panel 120 which defines a mounting panel for a plurality of modular displays. Typically, the displays include both alpha-numeric information, as indicated in a header panel 122 and graphic illustrations or the like as indicated in a plurality of individual modular display panels 124, 125, 126 and 127. The various display panels 122 and 124–127 are typically referred to as translite panels or "translites" and are made of Lexan. They may include four-color printing and may be backlighted to provide an aesthetically-pleasing display. The modular base panel 120 is generally of a translucent or substantially transparent material such as, by way of example, Lexan as is the scrolling web 52. Where desired, the modular base panel 120 may include opaque borders at 128 to frame the information panels, improving the display aesthetics.

As is best shown in FIGS. 10 and 12, the scrolling web 52 includes a plurality of mounting strips 130 mounted in spaced relationship on a line parallel to the axes of the take-up rollers 40 and 42. The mounting strips 130 are spaced outwardly from the web 52 by a plurality of elongated spacers 132, for defining mounting slots 134. The mounting strip 130 may be mounted on the web by use of double-backed adhesive tape, sonic welding, or by other means well known to those who are skilled in the art.

The various translite panels such as the modular base panel 120 include a plurality of mounting tabs 136. As best shown in FIGS. 10 and 13, the mounting tabs are creased at 138 to fold back over to form an inverted V or U-shaped member with the outer end 140 of the tab adapted to be inserted in the slot 134 for maintaining the translite panel on the web. The header panel 122 is similarly mounted on the modular panel 120, as are the various display translites 124–127.

As is best shown in FIG. 10, the modular base panel 120 may be made of a transparent substrate which is selectively covered with an opaque material for defining the various opaque border areas 128 and the transparent windows 149 behind the various translite panels 122 and 124–127. The windows 149 allow light to pass through the web 52 and the base panel 120 to illuminate the translites. The opaque border areas 128 assure that light does not leak between translite panels, providing a more aesthetic display.

As is particularly shown in FIG. 11, the vertical scrolling web 52 may include a plurality of translite panels 58, 59 and the like mounted directly on the scrolling web. The mounting means utilized with the embodiment of FIG. 11 is the same as that used for the base panel 120 and includes a plurality of spacers 132 mounted directly on the front surface of the web 52 to define a plurality of spaced gaps. The elongated strip 130 is secured to the front surface of the spacers 132, for defining the fastener tab receptive slots 134.

The scrolling sign mechanism of the subject invention is adapted to use the translite panels which were available in the prior an and were previously mounted directly on the frame 18 of the display unit. As is best shown in FIGS. 11, 13 and 14, a hanging strip 150 may be secured directly on the front surface of the rectangular translites 58, 59 or the like. As is specifically, shown in FIGS. 13 and 14, a double-backed adhesive may be applied to the rear surface (as drawn) of the strip 150. A protective pull strip 152 is secured to the adhesive to include premature attachment. Various hanging tabs 136 are integrally formed on the strip 150 and creased at 138 to define the slot engaging outer hanging tabs 140.

As is best shown in FIG. 13, the elongated strip 150 may be attached directly to the outer surface of the translite with the generally U-shaped fastener tabs 136 adapted to align with the slots 134. This permits the translite to be mounted on the web as shown in FIGS. 11 and 13. The space 154 between the outer edge of each mounting strip 130 and the tab bend or crease 138 permits the translite to slide in a direction parallel to the scrolling direction of the web for assuring that the information panel is always in a flat, planar condition when in the viewing window 16, while also allowing for slippage of the panel relative to the web for accommodating the varying radii created when the web and information panels are wound or unwound relative to rolls 40 and 42.

As shown in FIG. 15, an adhesive strip 158 alternatively may be secured to the rear surface (as drawn) of the translite 58 by means of a double-backed adhesive 160 to define the hanging tabs 136. The strip 158 is attached to the rear surface of the translite 58 (as drawn). In this configuration, the mounting strip 158 would not be visible from the front of the translite 58, and may be desirable in some applications.

Of course, as is shown in FIGS. 16 and 17, translite panels specifically constructed for use with the scrolling web mechanism may include integral mounting tabs 136 die-cut directly into the translite and formed to define the hanging tab 140.

An alternative embodiment for mounting the translites 58 on the web 52 is shown in FIGS. 18 and 19. As there shown, an elongate mounting strip 165 is mounted to the rear surface of the web 52 (FIG. 19) and fed through slots 166 and 168 provided through the web 52 for defining the mounting slots 134. The mounting tabs 136 on the panels 58 and the like may then be inserted in typical fashion.

Figure 19A:
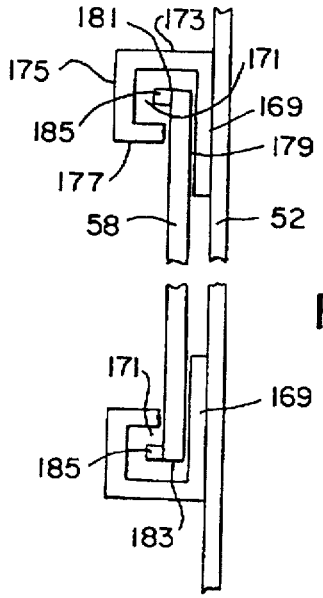
FIG. 19*a* illustrates another embodiment for mounting an information panel on a web.

Another alternative embodiment for mounting the translite 58 on the web 52 is shown in FIG. 19*a*. As there shown, the elongate mounting strip 169 is mounted on the web and includes a substantially rectangular channel 171 defined by the outer, horizontal member 173, the vertical section 175 and the inner horizontal section 177 which terminates in an outwardly spaced relationship with the strip 169 to define an opening 179. The outer ends 181 and 183 of the translite are adapted to be inserted in the channel 171 by sliding the translite across the face of the web, into the paper as drawn. An abutment member 185 is attached to the outer ends of the panel 58 and assures that the translite panel 58 will be maintained in the channels 171 of the strips 169. It will be noted that the channel 171 is large enough to accommodate movement of the translite 58 relative to the web 52 as the web and translites are scrolled onto the web rolls. The strips 169 may extend along the entire width of the web 52 or may be a series of spaced tabs. It will be understood where a series of spaced tabs are used that the mounting members 185 may also be in spaced apart strips, permitting the translite to be inserted in the channels 171 without sliding the translite across the entire face of the web 52.

Figure 20:
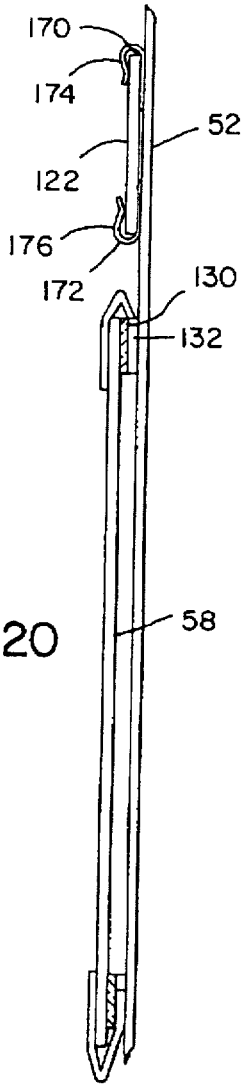
FIG. 20 illustrates another embodiment for mounting an information panel on a web.
Figure 21:
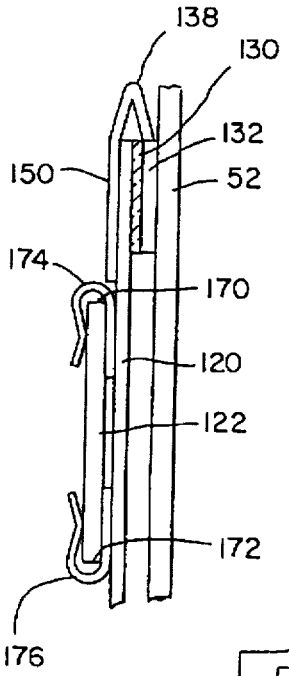
FIG. 21 is a view looking in the same direction as FIG. 20, illustrating another embodiment for mounting an information panel on a web.

Additional embodiments for mounting the information panels on the web are shown in FIGS. 20–23. As specifically shown in FIGS. 20 and 21, the translite header panel 122 is an elongated narrow strip having outer edges 170 and 172 extending in a direction substantially parallel to the axes of the web rollers 40 and 42 when installed on the web 52. A substantially U-shaped strip 174 is mounted on the web and a corresponding strip 176 is mounted on the web under strip 174, defining opposing U-shaped channels for receiving the outer edges 170 and 172 of the strip header panel 122. Typically, the strips 174 and 176 are made of a resilient plastic material for creating a spring clip for holding the panel 122 in place. Of course, the U-shaped strips 174 and 176 may also be used in combination with the modular base panel 120, as shown in FIG. 21. As is also shown in FIG. 20, the plastic spring strips 174 and 176 may be used in combination with other fastener configurations or may be used alone, as desired.

Figure 22:
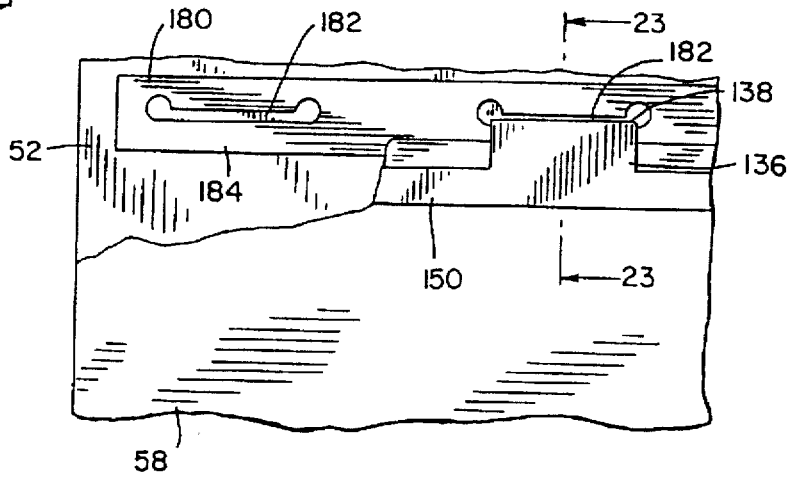
FIG. 22 is a view looking in the same direction as FIGS. 9 and 11, illustrating another embodiment for mounting an information panel on a web.
Figure 23:
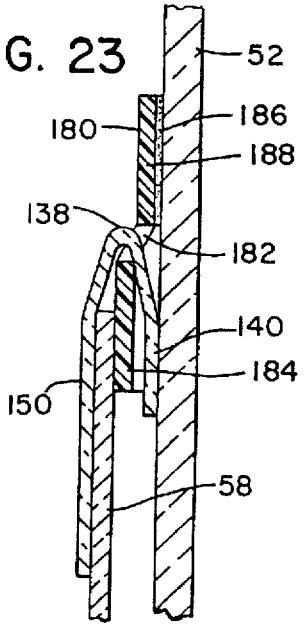
FIG. 23 is a fragmentary section view taken generally along the line 23—23 of FIG. 22.

As shown in FIGS. 22, 23, an elongated strip 180 may be attached to the web 52 in any suitable means such as, by way of example, sonic welding, adhesive or the like. The strip 180 includes a plurality of elongated through slots 182. As best shown in FIG. 23, the lower edge 184 (as drawn) at the edge of the strip is free. A stripe of adhesive 186 secures the upper edge 188 of strip 180 directly to the face of the web. The ends 140 of mounting tabs 136 may then be inserted in the slots 182 as shown in FIG. 23. A like strip 180 is adhesively attached to the web beneath the information panel 58 for receiving complementary mounting tabs attached to the lower edge of the information panel 41. The tabs 136 are free to move relative to the slot 182, permitting the information panel 58 to move relative to the web in a direction substantially parallel to the scrolling direction of the web, as in the previously described embodiments.

Figure 24:
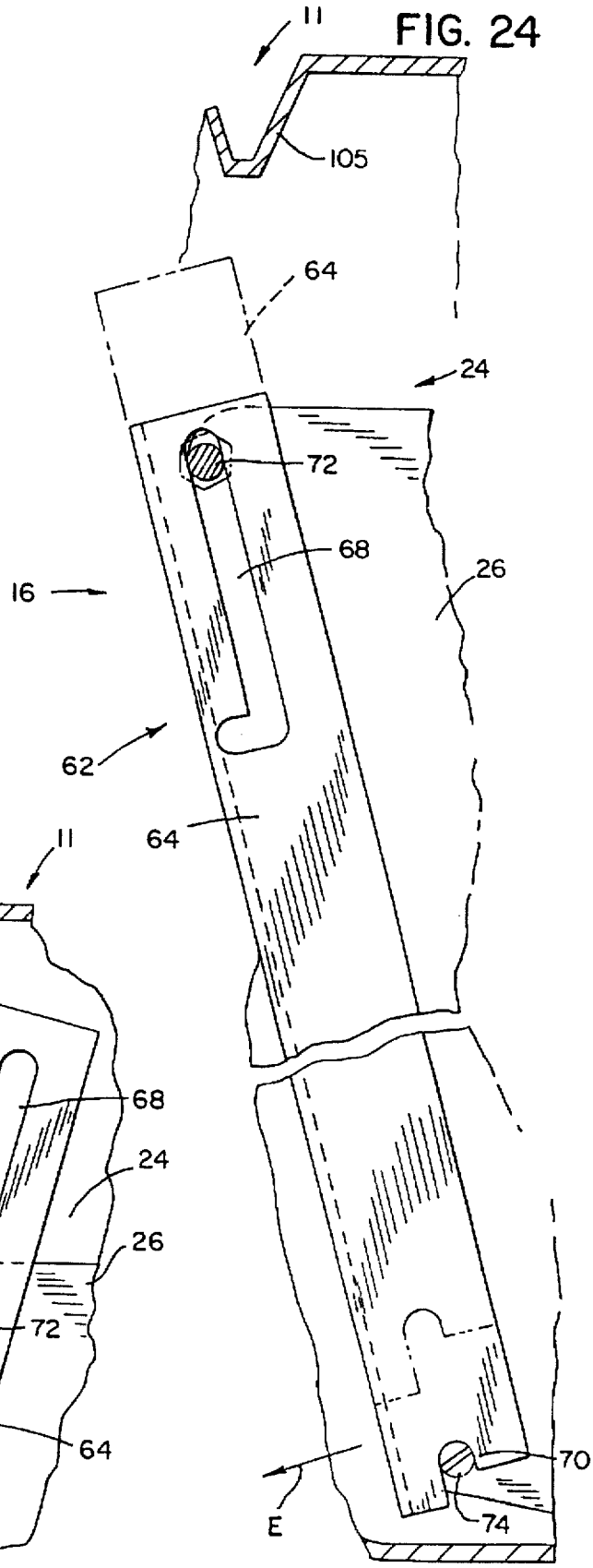
FIG. 24 is a fragmentary elevation view, partially in section, illustrating a hinge mechanism for a vertically scrolling sign.
Figure 25:
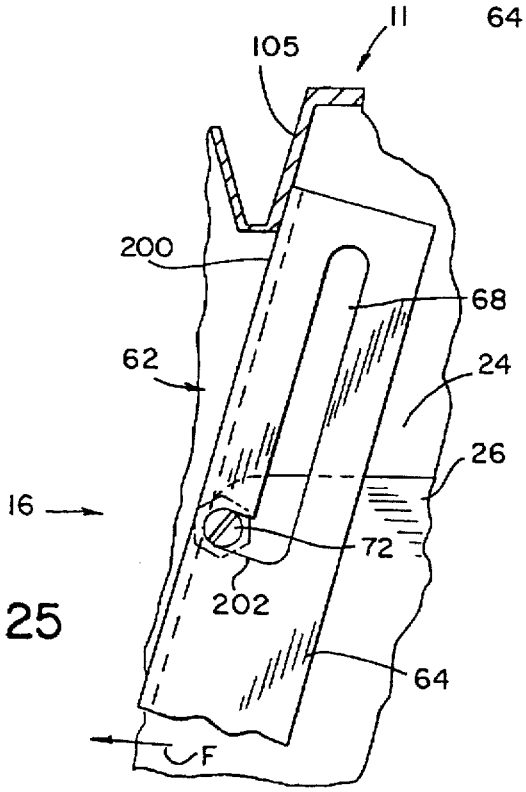
FIG. 25 is a fragmentary view similar to FIG. 24, showing the hinged mechanism in the open position.

FIGS. 24 and 25 illustrate the use of the transparent cover 62 (see FIG. 3) in combination with the framework for the scrolling web mechanism 24. The brackets 76 have been deleted from the view to assist in clarity. The configuration of box 11 is as shown in FIG. 6, however it will be readily understood that the cover assembly will work in a similar manner in a variety of box configurations. The frame for supporting the cover 62 includes the side members 64, as is particularly shown in FIG. 3. An elongated L-shaped slot 68 is provided in the upper end of each frame and a U-shaped open ended slot 70 is provided at the lower end. The frame is mounted on the assembly by placing the shoulder bolts 72 through the mechanism side walls 26 and 28 and through the slots 68 of the outer frame 64. The frame is held in the closed position of FIG. 24 by placing the shoulder of shoulder bolt 74 through the open U-shaped slot 70. In order to open the cover and permit access to the translites and various information panels mounted on the web 52, the cover frame 64 is moved upward to the phantom position shown in FIG. 24 and swung out as indicated by arrow E. After the cover has been swung out sufficiently to clear the abutment 105 of the box upper panel, the cover frame 64 is moved upward to the position shown in FIG. 25, with the outer wall 200 of the frame 64 in abutting engagement with the inclined surface 105 of the box. At this point, the shoulder of shoulder bolt 72 may be received in the L-shaped run 202 of the slot 68 to hold the cover in an open position, for gaining access directly to the web 52. In order to close the cover, the frame 64 is swung outwardly as indicated by the arrow F in FIG. 25, to remove the shoulder of shoulder bolt 72 from the slot 202 and return it to the elongated portion of the L-shaped slot 68, allowing the frame to slide down, where it may be swung back into the closed position with the shoulder of shoulder bolt 74 positioned in the lower U slot 70, as shown in FIG. 24.

FIGS. 26–35 disclose embodiments for mounting alphanumeric information strips such as menu and pricing panels on the scrolling web mechanism in accordance with the subject invention. As shown in FIG. 26, a menu base panel 204 is attached to the web 52 in the same manner as the other information panels, utilizing a plurality of mounting tabs 136. The panel 204 may be transparent or may include border or framing areas of an opaque nature with transparent windows for transmitting light for backlighting the menu items. The menu items such as, by way of example, the "DESSERTS" panel 206 are mounted on the menu base 204 in a plurality of channel strips 208. The panel sap 208 is an elongated, substantially rigid structure and, as better shown in FIGS. 27 and 28, is slightly bowed to conform to the arc of the web 52 as the menu base panel 204 and the web are wound around one of the rolls. The bow also reduces the overall radius of the wound web, as shown in FIG. 28. The outer, U-shaped ends 212 and 214 define a channel for engaging the outer side edges 216 and 218 of the information strip 206 (see also FIG. 34). By providing the arced or bowed cross-section on panel strip 208, the information strip 206 is held with a three-point contact, at each edge 216 and 218 and along the center line. This maintains it in tension, firmly holding it in place as the web is scrolled and flexed by the mechanism. This is particularly important for dynamic sign systems such as that shown in the preferred embodiment, when the various components are adapted to be moved and flexed.

In the preferred embodiment, the channel strip 208 comprises a substantially rigid, non-stretchable, translucent plastic member, through which light may be transmitted for backlighting the information strip 206. In order to permit the menu panel 204 and channel strips 208 to be wound about the rolls 40 and 42 of the scrolling web mechanism, the channel strip 208 is only secured to the base panel 204 at its center section as indicated by the longitudinal, spaced apart ribs 220, 221. In the preferred embodiment, the ribs are sonically welded to the base menu panel 204. As will be understood by those skilled in the art, other means such as double-backed adhesive tape or the like could be used to attach the strips 206 to the base 204.

The information strip 206 generally comprises a Lexan or similar material having opaque areas with transparent lettering, providing an aesthetically, pleasing backlighted menu strip when mounted on the menu base panel 204 in the channel strips 208. The information strip 206 may include permanent lettering for specific menu items or, as shown in FIGS. 29–33, may comprise the base strip 222 made of an opaque material with a plurality of transparent windows 224 over which individual indicia members 226 may be placed to provide a variable letter/number strip to be utilized in combination with the channel strips 208. The strip 222 and indicia member 226 combination is used in the same manner as the permanently lettered strip 206.

As is shown in FIGS. 29 and 30, the strip 222 is through die-cut at 228 and 230 on either side of the respective windows 224. The indicia member 226 may be slidably inserted in position over a window 224 with the outer edges of the die-cuts 228 and 230 engaging the sides of the member 226 as shown in FIG. 30, for holding it in position on the strip 222. This permits frequently changing information such as pricing and the like to be readily changed without the reprinting of a new permanently lettered strip.

In certain applications, the backlighting behind the strip 222 may leak between the die-cut and the indicia member along the die-cut lines 228 and 230, creating an aesthetically unpleasing appearance. In order to reduce the likelihood of light leaks, the information strip 222 may be modified, as shown in FIGS. 31–33. Specifically, an elongated, uncut opaque back panel 240 may be secured in abutting relationship with the information strip 222 with corresponding transparent areas positioned in alignment with the windows 224. As is more clearly shown in FIGS. 32 and 33, when the indicia member 226 is inserted between the die-cut slits 228 and 230, and positioned in front of the window 224, the base panel 240 is behind the die-cuts and the indicia member and provides a solid opaque background in the area of the die-cuts to preclude the leakage of light therethrough. When this configuration is used, the back panel 240 is secured to the information panel strip 222 in an area that does not interfere with the die cuts. In the preferred embodiment, adhesive is applied between layers either on the leader portion 249 of the strip (FIG. 29) or in the window areas 224 (FIG. 32).

It will also be noted that the side edges 242 and 244 of the base panel 240 are spaced inwardly from the side edges 216 and 218 of the strip 222. This is to assure that the strip 222 will be readily received in the U-shaped channels 212 and 214 of the channel strip 208, without additional interference due to the increased thickness caused by the base strip. It should also be noted that the outer edges of the indicia members 226 are engaged by the U-shaped channels 212 and 214 (see FIG. 32) for securing the member in the assembly and for blocking any light leakage.

A plurality of alpha-numeric information strips 206, 222 and the like may be placed in each of the channel strips 208. When this is done, the strips are placed in side-by-side relationship with one another. In order to eliminate any light leakage between adjacent strips, at least one end of the abutting adjacent ends is tapered to a point 248, as shown in FIGS. 29, 34 and 35. The tapered point 248 permits the channel strip 222, as shown, to slide in and under adjacent strip 206 so that the edges of the strips are in overlapping relationship. This precludes the leakage of light between strips and assures a more aesthetically pleasing display.

While certain features and embodiments of the invention have been described in detail herein, it will be understood that the invention includes all enhancements and modifications within the scope and spirit of the following claims.

What is claimed is:

1. A changeable information display comprising:

a. a base panel;

b. a plurality of elongated mounting channels secured to the base panel, said mounting channels having a length and a predetermined width taken in a direction normal to said length, each of said mounting channels comprising generally C-shaped integral structure having a back wall with a pair of sides and having a side retainer along each side of said back wall, said side retainers extending along the length of said mounting channel and being spaced apart along the predetermined width of said mounting channel;

c. at least one information panel comprising an elongate strip adapted to be slidably received in one of said channels and secured therein by said side retainers; and wherein d. the back walls of said channels are secured to the base panel along the length of the channels and across a span less than the predetermined width of the channels;

e. said information panel comprises a base layer made of an opaque substrate and includes light transmitting windows therein having opposing sides, and further including a through slit on each side of the windows; and f. said information panel further includes removable inserts and said inserts are adapted to be slidably received in said slits and positioned in overlying relationship with said windows.

2. The changeable information display of claim 1, wherein said information panel further includes an opaque underlayer disposed in underlying relationship with said slits.

3. The changeable information display of claim 1, wherein the mounting channels are bowed between said spaced apart side retainers.

4. The changeable information display of claim 1 wherein the removable inserts are adapted to be engaged by said side retainers.

5. The changeable information display of claim 1 wherein said back walls of said mounting channels are secured to said base panel at a pair of locations spaced apart in the direction of the predetermined width of said channels.

6. A scrolling web sign mechanism for selectively displaying graphic or alpha-numeric information and for permitting ready alteration of the information, the sign mechanism comprising:

a frame having sides for defining a display window between the sides, said window having spaced apart edges;

an elongated flexible web having opposite ends and side edges adapted for substantially spanning the spaced apart edges of the window;

a pair of rollers, one each rotatably mounted in the frame on either side of the window, each of said rollers being adapted for receiving one of the ends of the web, rotation of the rollers scrolling the web past the window as the web is unwound from one of said rollers and wound on the other of said rollers;

at least one display panel means displaying the graphic or alpha-numeric information;

mounts secured to said web for releasably securing said display panel means to said web;

said display panel means including a base panel releasably secured to said mounts on said web and a plurality of information panels secured to the base panel; said base panel including a plurality of elongated mounting channels having a length and having spaced apart side retainers extending the length thereof, and wherein said information panels comprise elongated strips adapted to be slidably received in said channels and secured therein by said side retainers.

7. The scrolling web sign mechanism of claim 6 wherein said mounting channels are of a predetermined width normal to said length and wherein the channels are secured to the base panel along the length of the channel and across a span less than the predetermined width of the channel.

8. The scrolling web sign mechanism of claim 6 wherein said information panels comprise a base layer made of a light transmitting substrate and includes opaque borders thereon forming windows in said base layer having opposing sides, the base layer further including a through slit on each side of each of said windows, and wherein said inserts are adapted to be slidably received in said slits and positioned in overlying relationship with said windows.

9. The scrolling web sign mechanism of claim 6 wherein said information panels further include removable inserts.

* * * * *